United States Patent [19]

Santoro

[11] Patent Number: 4,805,494

[45] Date of Patent: Feb. 21, 1989

[54] ARTICULATE HAMMER

[76] Inventor: Richard Santoro, 1621 Bayo Vista Ave., San Pablo, Calif. 94806

[21] Appl. No.: 88,270

[22] Filed: Aug. 24, 1987

[51] Int. Cl.[4] ..... B25G 1/06

[52] U.S. Cl. ..... 81/20; 81/177.8; 81/489

[58] Field of Search ..... 81/20, 26, 177.7, 177.8, 81/177.75, 177.85; 403/58, 97, 489

[56] References Cited

U.S. PATENT DOCUMENTS

| | | | |
|---|---|---|---|
| 50,262 | 10/1865 | Monson | 81/20 |
| 1,268,734 | 6/1918 | Lay | 81/177.8 |
| 2,436,336 | 2/1948 | Slater | 403/58 |
| 2,463,971 | 3/1949 | Jackson | 403/58 |
| 4,363,344 | 12/1982 | Pollack | 81/20 |

*Primary Examiner*—Frederick R. Schmidt
*Assistant Examiner*—Blynn Shideler
*Attorney, Agent, or Firm*—Harry A. Pacini

[57] ABSTRACT

This invention relates to a hammer with an adjustable head member relative to a handle member, said adjustment through a double jointed member means for aligning and securely but movably locking the hammer head and handle in various relative angular positions whereby full force is transmitted from the handle to the hammer head.

2 Claims, 3 Drawing Sheets

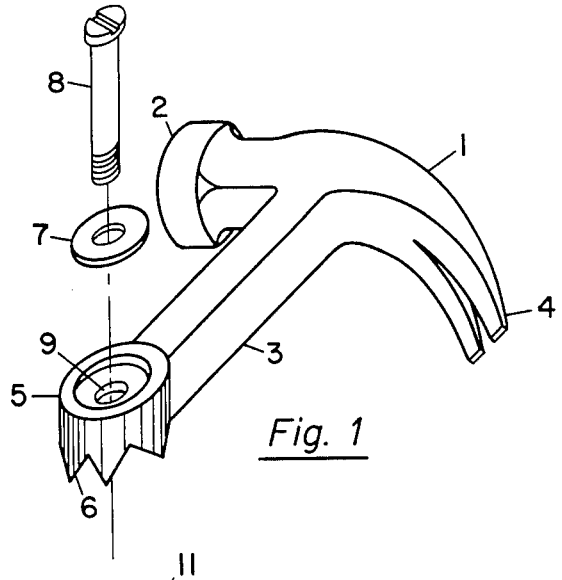
Fig. 1
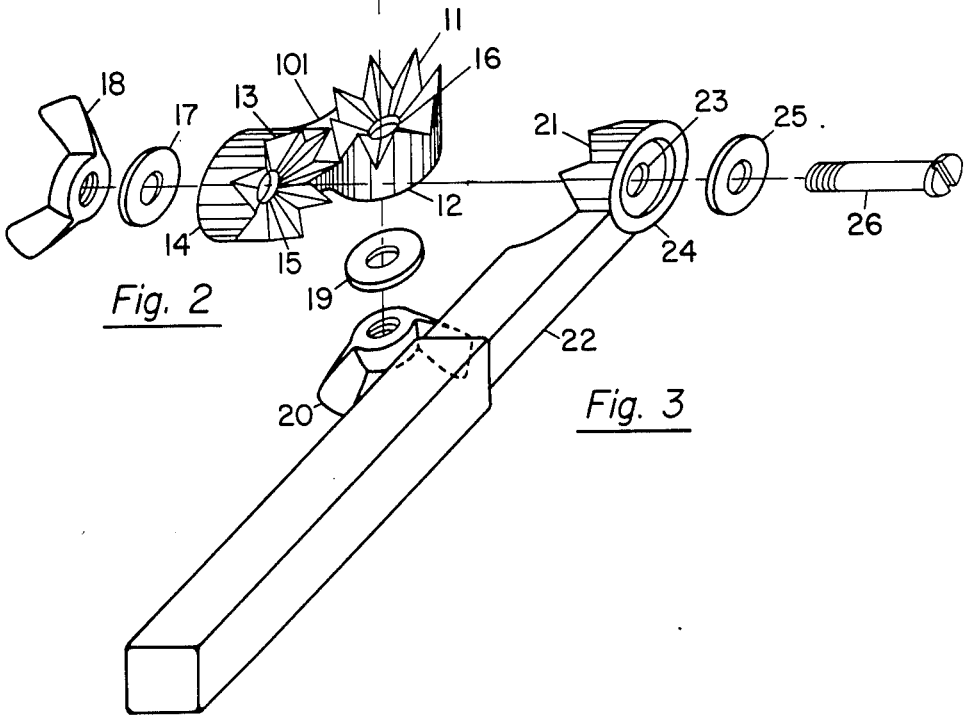
Fig. 2
Fig. 3

4A

4B

4C

ARTICULATE HAMMER

BACKGROUND OF THE INVENTION

Manually operated hand tools of the type to be gripped with the hand often have handles which are disposed in a fixed axial alignment with respect to the operative head of the tool, for example, the hammer. When the handle is gripped in the hand it is necessary to rotate the handle and the attached head by wrist action. Often such movement or positioning of the hand is difficult and sometimes impossible.

In the case of hand tools, as the hammer with a striking head and gripping handle attached thereto, oftentimes it is difficult to apply sufficient torque to the handle to obtain the force needed for effective operation as a hammer. This difficulty is due to the limited leverage obtainable in confined spaces by gripping the handle and turning the same by action of the wrist and arm in a striking motion.

Heretofore there have been no proposed means for improving the mechanical advantage obtainable with the hammer. Due to the force and motion required for the action of the hammer evidently no attempts have been made to improve the design of the classical hammer. Accommodation of the problem of confined working space locations, or where surrounding parts or equipment interfere with the use of handles and hammer heads of the usual classical configuration.

Moreover, the use of an axial handle where position is fixed, greatly limits the use of such tools in inaccessible or crowded locations. Such circumstances prohibit the handle of the hammer from being gripped properly and moved in the normal manner of use for operation in the restrictive location.

SUMMARY OF THE INVENTION

The invention, briefly described, relates to a hammer comprising a position adjustable head having a shank with a circular lateral extension having a plurality of radially disposed locking teeth, a handle having at one end a lateral circular extension having a plurality of radially disposed locking teeth, an adjustable coupling member which is a locking joint having a first lateral circular extension and a second lateral circular extension at right angles to each other, each extension having a plurality of radially disposed locking teeth adapted to mate with a plurality of similarly disposed teeth on the handle extension and on the hammer head shank, and each lateral circular extension having means for adjustably securely locking to one joint of the coupling member.

An object of this invention is to provide a hammer which can have its head adjusted to many different positions relative to the handle.

A further object of this invention is to provide a hammer of improved utilitarian construction and thereby increase the efficient and effective use of said hammer.

Yet a further object of this invention is to provide an adjustable hammer which may be readily adjusted for use in various positions and to hold the same locked position through out its use with a wide range of work.

With these and other objects of this invention in view, the invention hereinafter will be more fully described, illustrated in the accompanying drawings.

Hence these and other objects will become more apparent from the specification and drawings.

BRIEF DESCRIPTION OF THE VIEWS OF THE DRAWINGS

FIG. 1 is a perspective view of the hammerhead, shank and lateral circular extension.

FIG. 2 is a perspective view of the adjustable locking coupler joint with transverse first lateral joint and second lateral joint.

FIG. 3 is a perspective view of the handle shank with lateral circular extension at one end.

Similar numbers of reference refer to similar parts throughout the several views.

DETAIL DESCRIPTION OF THE INVENTION

Figure 4:
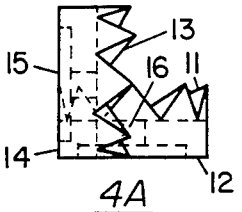
FIG. 4 is a detail drawing of three elevation views of the adjustable locking coupler.
Figure 4:
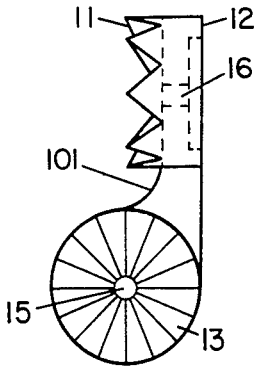
Figure 4:
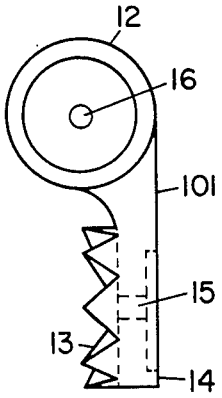

The articulated hammer of this invention consists of a conventional hammer head 1 on one side of which is formed the usual nail-driving face 2 and on the opposite side of which are the claws 4. For purpose of illustration in the following description, the conventional hammer with a nail-driving face and claws on the opposite side is used. It is understood that the general description, configuration and construction of the hammer can be used for various other types of hammers.

Therefore, the head of the hammer is provided with a shank 3 which terminates in a lateral circular extension 5. The circular extension 5 has one face at right angle to the hammer head. Said face has radially disposed plurality of locking teeth 6. The lateral circular extension 5 is provided with a centrally located bore 9 to receive the threaded bolt 8 and washer 7 or other means for removably securing the bolt on the side opposite the locking teeth. Exemplified in FIGS. 1 and 2, said threaded bolt 8 is threaded to receive a wing nut 20 and washer 19.

Said radially disposed locking teeth 6 are adapted to engage with the teeth 11 of the first joint 12 of the adjustable locking coupler 101. By means of the threaded bolt 8 and nut 20 the hammer head and adjustable locking coupler 101 may be secured in a locked adjustable position, the interlocking teeth 6 engage with the teeth 11 of the coupler and thereby prevent the shift of the head 1 relative to the locking coupler 101 and the handle. The interaction of the coupler with the each of the hammer head member and the handle member will be come evident in the following description.

The adjustable locking coupler 101 is generally a first circular extension joint 12 and a second circular extension joint 14 joined together at right angles to each other. Each circular extension joint has a set of radially disposed locking teeth 11 and 13, respectively, around a bore in each extension joint 15 and 16, respectively. The bore in each instance is a central opening in each extension joint. Central opening or bore 16 cooperates and accepts the passage of bolt 8 or means for rigidly connecting and engaging with washer 19 and wing nut 20. The nut 20 and bolt 8 serve to normally maintain the two sets of radially disposed teeth 6 and 11 in relatively secured interlocked relationship. This bolt 8 also serves as a pivot point about which the hammer head member can be moved to adjust the alignment or angle of the hammer head 1 relative to the handle 22.

The handle 22 is of reasonable length and can be of conventional shape, such as square, oval, circular and the like. At one end of the handle 22 there is provided a lateral circular extension joint 24 with radially disposed locking teeth 21 adapted to mate with similar teeth 13 of the second joint 14 of the adjustable locking coupler 101. A central opening 23 is provided in the extension 24. The central opening 23 cooperates with and accepts the passage of bolt 26 or other means for rigidly connecting the two joints. Bolt 26 and washer 25 rests in a recessed area on the side opposite the locking teeth 21 on extension joint 24, and central opening 15 cooperates and accepts the passage of bolt 26 therethrough or other means for rigidly connecting the two joints. Bolt 26 engages with washer 17 and wing nut 18. The nut 18 and bolt 26 serve to normally maintain the two sets of radially disposed teeth 13 and 21 in relatively secured interlocked relationship. Bolt 26 serves as a second pivot point about which the hammer head 1 can be moved, securedly adjusted, and angularly positioned relative to the handle 22.

Figure 5:
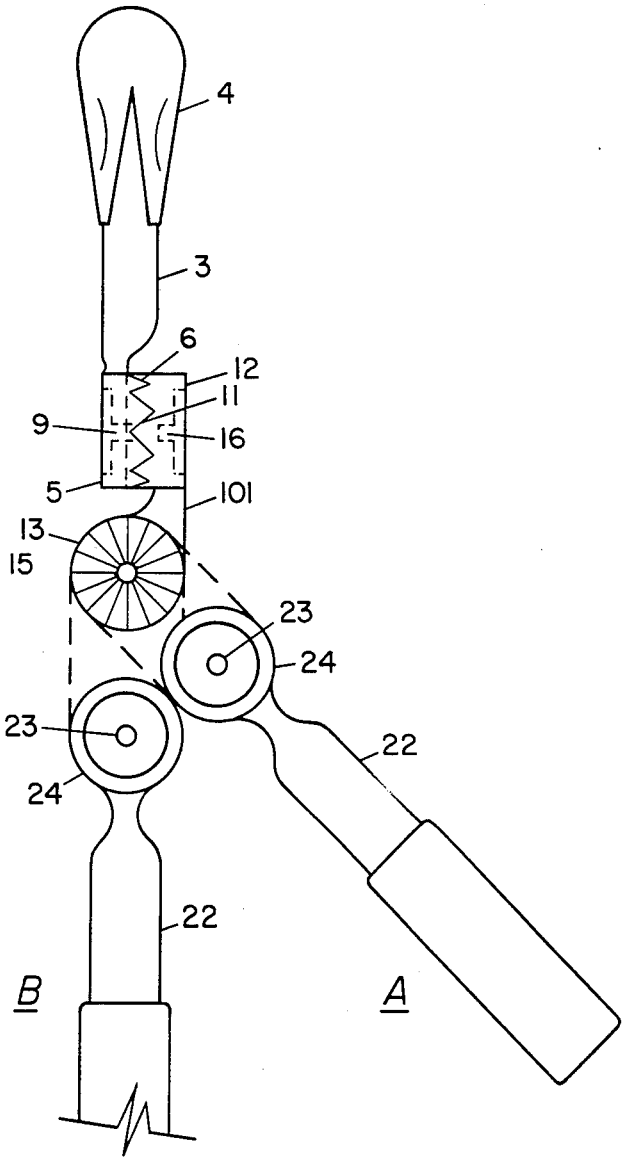
FIG. 5 is a planer drawing showing the hammer head locking in place and the handle shank assembly represented in two alternate movable positions, A and B.

With reference to FIG. 5, it can be seen how the hammer head 1 connects through the hammer shank 3 and lateral circular extension 5 in an interlocking secured mating relationship with the adjustable coupling member 101 at the first joint 12 with its interlocking teeth 11. At FIG. 5A and 5B one can see how the handle 22 can be positioned at different angles relative to the position of the hammer head 1 through the adjustable coupling member 101 at the second joint 14. Hence, it can be seen that the hammer head 1 and handle 22 can be adjusted through the coupling member 101 to be in different planes disposed at various angular relationships to each other.

Adjusting of the desired and various angular relationship between the handle 22 and the coupling member 101 and the hammer head 1 is performed by loosening the means for securely fastening the interlocking joints together. In the embodiment illustrated in the drawings, the means for fastening are bolts and wing nuts 18 and 20 which are to be loosened before rotating the handle 22 on the screw 26 or rotating the hammer head 1 on the screw 8, respectively, and then tightening the nut 18 or 20 to force the toothed faces of the extensions 101 at 11 or 13, respectively, into interlocking mating relationship with faces 6 or 21, respectively. Therefore, relative rotation of either the hammer head 1 or handle 22 is about the bolts 8 or 26, respectively.

Thus the two centers of adjustment, namely the center of pivotal adjustment of the handle member 22 and the coupling member 101, and the center of rotary adjustment of the hammer head member 1 and the coupling member 101 are aligned and in a plane disposed at right angles to the face of each of the first joint 12 and second joint 14 upon which the locking teeth 11 and 13, respectively, are radially disposed. Therefore, by movement of the handle 22 through a striking motion, full force is transmitted to the hammer head 1. By virtue of this construction when the parts are locked in any desired angular relationship and force or striking motion on the handle will tend to urge the hammer head against the surface to be struck and will be translated to said surface in terms of a substantially direct thrust. In other words, there is no substantial tendency for the hammer head 1 to tilt or turn in operation regardless of its position relative to the handle 22.

It will be understood that the double joint coupling member 101 is applicable for connection of the handle for direct force transmission at various angles to the striking surface. The manufacture and assembly of the parts is simple and direct. Replacement of worn or broken members can be easily affected by unskilled individuals.

Thus it will be seen that there is herein described apparatus in which the several features of this invention are embodied, and which apparatus in its action attain the various objectives of the invention and is of practical utility.

Without further elaboration, the foregoing will so full illustrate the invention that its advantage will be apparent to one skilled in the art to which this invention pertains and that various changes maybe made in the form, construction and arrangement of the parts without departing from the spirit and scope of the invention or sacrificing its advantages and objectives. The forms herein described and illustrated in the drawings are preferred embodiments thereof.

What is claimed is:

1. A hammer with a hammer head having a shank extending to a circular extension, a handle having at one end a circular extension, said hammer head circular extension having a plurality of radially disposed locking teeth about a central bore and said handle lateral circular extension having a plurality of radially disposed locking teeth around a central bore and an adjustable coupling member interposed therebetween wherein said coupling member is a first lateral circular extension and a second lateral circular extension at right angle to said first lateral circular extension, each extension having a centrally located circular bore with the locking teeth radially disposed around the bore, when each of said bores is individually aligned with the bore of said radially disposed locking teeth of said handle lateral circular extension and with the bore of said radially disposed locking teeth of said hammer head circular extension, respectively, each can accept a means for aligning and securely but movably locking the hammer head and handle in relative angular position one to the other.

2. The hammer of claim 1 wherein the means for aligning and securely but movably locking the hammer head and handle is a bolt and cooperating nut.

* * * * *